US007170734B2

(12) United States Patent
Muz

(10) Patent No.: US 7,170,734 B2
(45) Date of Patent: Jan. 30, 2007

(54) AIR IONIZATION DEVICE

(75) Inventor: Christof Muz, Reutlingen (DE)

(73) Assignee: Haug GmbH & Co. KG, Leinfelden-Echterdingen (DE)

( * ) Notice: Subject to any disclaimer, the term of this patent is extended or adjusted under 35 U.S.C. 154(b) by 166 days.

(21) Appl. No.: 10/300,691

(22) Filed: Nov. 19, 2002

(65) Prior Publication Data

US 2003/0142455 A1 Jul. 31, 2003

(30) Foreign Application Priority Data

Nov. 23, 2001 (DE) ..... 101 57 524

(51) Int. Cl.
*H05F 3/00* (2006.01)

(52) U.S. Cl. ..... 361/212; 361/225

(58) Field of Classification Search ..... 361/220, 361/231–234, 212, 225; 250/423 R
See application file for complete search history.

(56) References Cited

U.S. PATENT DOCUMENTS

| | | | | |
|---|---|---|---|---|
| 3,308,343 A | | 3/1967 | Smith et al. | |
| 3,308,344 A | | 3/1967 | Smith et al. | |
| 3,557,368 A | * | 1/1971 | Tano et al. | 250/324 |
| 3,624,448 A | | 11/1971 | Saurenman et al. | |
| 3,643,128 A | | 2/1972 | Testone | |
| 3,711,743 A | * | 1/1973 | Bolasny | 361/231 |
| 4,319,302 A | * | 3/1982 | Moulden | 361/213 |
| 4,333,123 A | * | 6/1982 | Moulden | 361/213 |
| 4,437,147 A | * | 3/1984 | Takamura et al. | 363/61 |
| 5,930,105 A | | 7/1999 | Pitel et al. | |

(Continued)

FOREIGN PATENT DOCUMENTS

| | | |
|---|---|---|
| DE | 1 224 848 | 4/1965 |

(Continued)

OTHER PUBLICATIONS

*Patent Abstracts of Japan*, Abstract of Japanese "High Voltage Generating Device", Publication No. 11251035, Sep. 17, 1999, Japanese Application No. 10066278, Filed Mar. 2, 1998.

(Continued)

*Primary Examiner*—Brian Sircus
*Assistant Examiner*—Danny Nguyen
(74) *Attorney, Agent, or Firm*—Lipsitz & McAllister, LLC

(57) ABSTRACT

The invention relates to an air ionization device comprising a high voltage line which can be connected to an AC voltage power source and point electrodes which are coupled capacitively to the high voltage line for generating a corona discharge. In order to develop the air ionization device further in such a manner that it has a greater efficiency for the discharge of a dielectric object, it is suggested in accordance with the invention that the air ionization device comprise at least two point electrodes which are each connected via a diode to a DC voltage potential and each via an associated capacitor to the high voltage line, wherein the first point electrode is connected to the cathode side of the associated diode and the second point electrode to the anode side of the associated diode, and wherein a corona discharge can be formed between the two point electrodes and positive charge carriers can be generated at the first point electrode and negative charge carriers at the second point electrode continuously and simultaneously.

12 Claims, 4 Drawing Sheets

Figure 1:
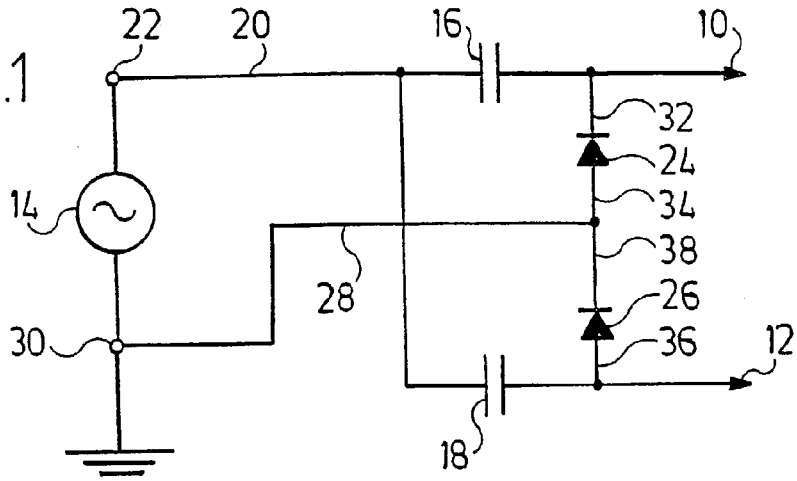

U.S. PATENT DOCUMENTS 6,118,645 A * 9/2000 Partridge ..... 361/231
6,130,815 A 10/2000 Pitel et al.
6,693,788 B1 * 2/2004 Partridge ..... 361/231

FOREIGN PATENT DOCUMENTS

DE 26 31 096 1/1978
DE 26 46 798 4/1978

OTHER PUBLICATIONS

*Patent Abstracts of Japan*, Abstract of Japanese Patent "Negative Ion Generator", Publication No. 10199654, Jul. 31, 1998, Japanese Application No. 09013056, Filed Jan. 7, 1997.

* cited by examiner

AIR IONIZATION DEVICE

The invention relates to an air ionization device comprising a high voltage line which can be connected to an AC voltage power source and point electrodes which are coupled capacitively to the high voltage line for generating a corona discharge.

Air ionization devices are used, in particular, for eliminating electrostatic charging of objects, in particular, of dielectric objects consisting of flat material, for example, films, and are known, for example, from U.S. Pat. No. 3,643,128 as well as from DE-AS 1 224 848 and U.S. Pat. No. 3,308,344. In addition, unipolar electric charges can be applied to a dielectric object to be charged by means of air ionization devices. It is necessary to generate free charge carriers not only for charging an object but also for its discharging. This is brought about by means of the point electrodes, to which a high voltage is applied so that a corona discharge is triggered and free charge carriers are formed. If the point electrodes are connected to a negative high voltage, negative charge carriers are generated which are then available for the charging or discharging. If the point electrodes are connected to a positive high voltage, positive charge carriers are generated accordingly. The charge carriers can then be directed—for example, by means of a flow of air—onto the object to be discharged or charged.

The point electrodes are, normally, connected either directly to a high voltage or, however, with the interposition of ohmic resistors or capacitors. A direct coupling has the advantage of a very effective generation of charges but it has the considerable disadvantage of a lack of insulation. It is, in addition, a disadvantage that the voltage supply device is overloaded when a short circuit develops at an individual point electrode on account of a lack of any limitation of the discharge current supplied to the point electrodes and, consequently, the high voltage breaks down at all the point electrodes.

In order to be able to ensure the insulation necessary to protect against accidents, shock-proof, ohmic resistors can be used, with which the flow of electronic current supplied to the point electrodes can be limited. The limitation of current results, in addition, in the fact that the entire supply of high voltage does not break down during a short circuit at one point electrode and, consequently, the remaining point electrodes can be supplied with high voltage even during any sparking at one point electrode. The use of shock-proof resistors does, however, entail quite considerable costs.

Alternatively to using shock-proof, ohmic resistors, it is known to couple the point electrodes capacitively to an AC high voltage so that the discharge current supplied to the point electrodes can be limited by way of suitable dimensioning of the capacitors used without additional ohmic resistors being necessary. The use of capacitors makes the use of an AC high voltage imperative. For this purpose, a high-voltage generator is suggested in the Abstract of the Japanese patent specification JP 11-251 035 A, wherein an AC high voltage can be supplied to two capacitors which are each connected to a DC voltage potential via a diode, wherein an AC voltage can be tapped each time between the capacitors and the diodes. One of the diodes is connected to the DC voltage potential on the cathode side and the other diode on the anode side. The voltages tapped in this manner may be used for generating positive and negative charge carriers which can be generated one after the other with respect to time. The efficiency which can thereby be achieved for discharging a dielectric object is, however, limited.

The object of the present invention is to further develop an air ionization device of the type specified at the outset in such a manner that it has a greater efficiency for the discharge of a dielectric object.

This object is accomplished in accordance with the invention, in an air ionization device of the generic type, in that the air ionization device comprises at least two point electrodes which are each connected via an associated diode to a DC voltage potential and each via an associated capacitor to the high voltage line, wherein a first point electrode is connected to the cathode side of the associated diode and the second point electrode to the anode side of the associated diode, and wherein a corona discharge can be formed between the two point electrodes and positive charge carriers can be generated at the first point electrode and negative charge carriers at the second point electrode continuously and simultaneously.

The inventive air ionization device can be used for the discharge of a dielectric object. For this purpose, the air ionization device comprises at least two point electrodes which are each connected to a DC voltage potential via a diode, wherein the first point electrode is connected to the cathode side of the associated diode and the second point electrode to the anode side of the associated diode. Such a configuration ensures that not only positive but also negative charge carriers can be generated for eliminating any electrostatic charging of dielectric objects. Since the first point electrode is connected to the diode on the cathode side, this diode is connected in reverse direction when a positive half wave of the AC voltage is present whereas the diode connected to the second point electrode is connected in forward direction when a positive half wave of the AC voltage is present on account of the connection of the second point electrode to the anode side. Conversely, when a negative half wave is present, the diode connected to the first point electrode is connected in forward direction and the diode connected to the second point electrode in reverse direction. As a result, a difference in potential is permanently effective following subsidence of transient effects between the two point electrodes and this difference corresponds essentially to the point-point value of the AC high voltage made available by the AC voltage power source. Consequently, charge carriers with positive and negative polarity are generated continuously and simultaneously and so the air ionization device has a high efficiency for the discharge of an object.

Since a difference in potential corresponding essentially to the point-point value of the available AC high voltage is effective between the two point electrodes, the amplitude of the AC voltage supplied can be selected to be considerably less than is the case for conventional point electrodes which are coupled capacitively. On the other hand, this results in a considerable saving on costs, namely not only with respect to the AC voltage power source used during operation of the air ionization device but also with respect to the dielectric strength of the components of the air ionization device itself.

It is of particular advantage when the air ionization device has at least one third point electrode which is not coupled to a DC voltage potential. It has been shown that residual electrostatic charging of dielectric objects can also be reduced as a result of a combination of point electrodes which are coupled capacitively with and without additional DC voltage coupling. Residual charging of this type, so-called overcompensation, is difficult to avoid on account of the different mobilities of negative and positive charge carriers and the different positive and negative corona voltages used in the case of customary air ionization devices.

Earth potential is preferably used as DC voltage potential. Alternatively, the use of an adjustable, in particular, a regulatable DC voltage potential can be provided. The quantity ratio of the positive and negative charge carriers generated can be influenced by altering the DC voltage potential and, as a result, any possible overcompensation may be influenced.

It is of advantage when the diodes connected to the point electrodes are connected in series to a current limiting element, for example, an ohmic resistor since, as a result, the current flowing via the diodes in forward direction can be limited in order to avoid any damage to the diodes.

In order to be able to monitor the state of the point electrodes and make statements regarding the charges coupled out at the point electrodes, it is of advantage when the diodes connected to the point electrodes are connected to a measuring unit for determining the current flowing via the diodes. It can, for example, be provided for the diode current to be detected directly by means of a current measuring device. Alternatively, it may be provided for the drop in voltage developing via the current limiting element to be detected.

In order to eliminate electrostatic charging of extended objects, for example, wide films, it has proven to be advantageous when the air ionization device comprises at least two rows of point electrodes, wherein the first row has point electrodes which are connected to a diode on the cathode side and wherein the second row has point electrodes which are connected to a diode on the anode side. The point electrodes are each connected to a DC voltage potential via the diodes.

It is favorable when a third row of point electrodes is arranged between the first and the second rows of point electrodes, wherein these point electrodes are not coupled to a DC voltage potential, preferably, earth potential. It may, for example, be provided for all the respective point electrodes of the first row to be connected to the cathode of a diode and the respective point electrodes of the second row to the anode of a diode for the connection to a DC voltage potential and for point electrodes which have no coupling to DC voltage to be arranged between the first and second rows.

Alternatively and/or in addition, it may be provided for the air ionization device to have at least one row of point electrodes, in which point electrodes connected via a diode to a DC voltage potential and point electrodes not coupled to a DC voltage potential are arranged one after the other. In this respect, it is favorable when point electrodes connected via a diode to a DC voltage potential and point electrodes not coupled to a DC voltage potential interchange alternatingly.

It has proven to be advantageous when one point electrode not coupled to a DC voltage potential is arranged each time between two point electrodes coupled via a diode to the DC voltage potential. The point electrodes having a coupling to a DC voltage may, again, be connected alternatingly to the cathode or the anode of a diode.

In an alternative, advantageous development of the inventive air ionization device, it is provided for the air ionization device to comprise at least two rows of point electrodes, wherein in a first row point electrodes connected on the cathode side to a diode and via the diode to a DC voltage potential and point electrodes not coupled to a DC voltage potential are arranged alternatingly one after the other, and wherein in the second row point electrodes connected on the anode side to a diode and via the diode to a DC voltage potential and point electrodes not coupled to a DC voltage potential are arranged alternatingly one after the other.

Figure 2:
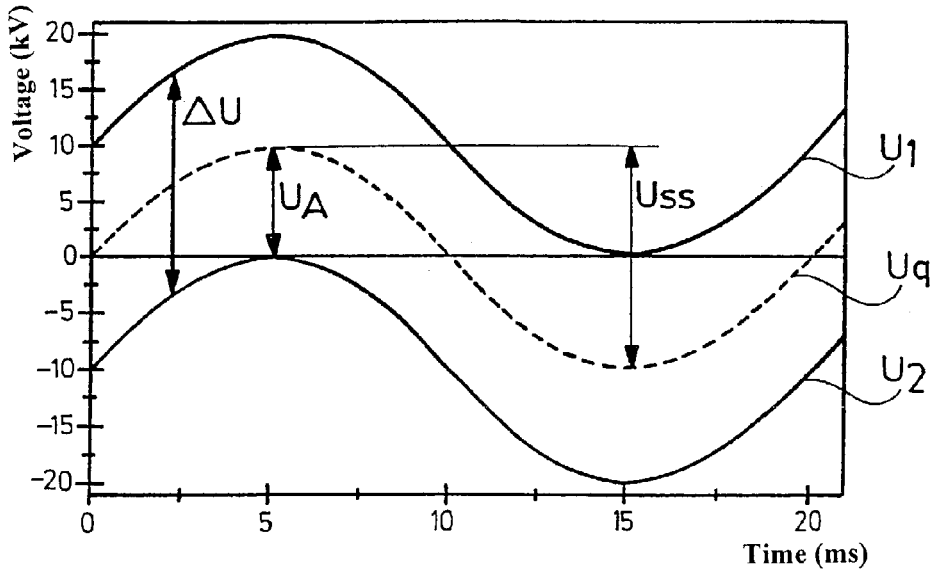
Figure 3:
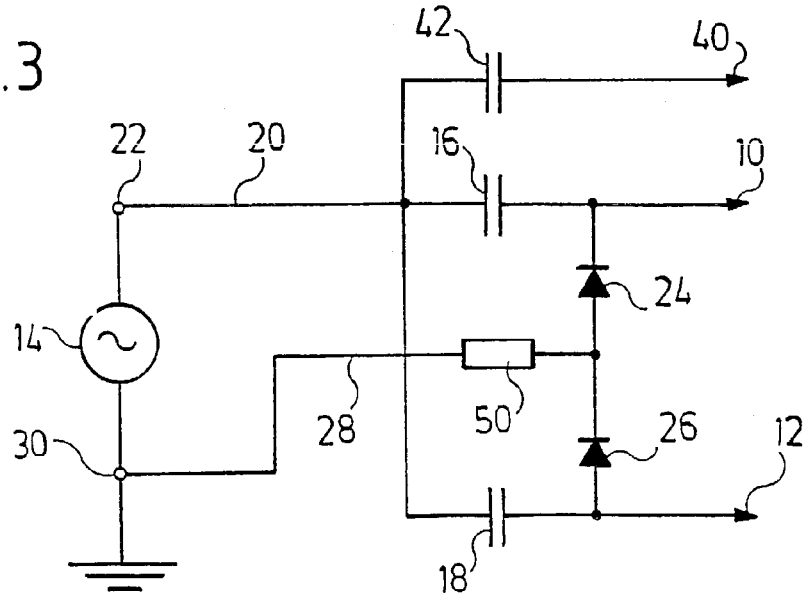
Figure 4:
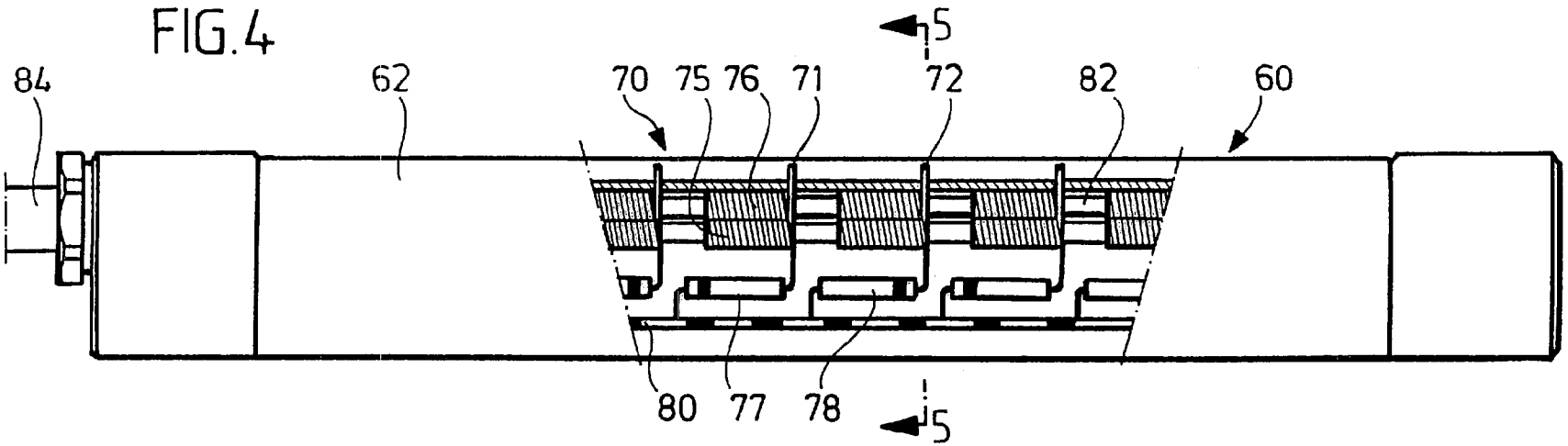
Figure 5:
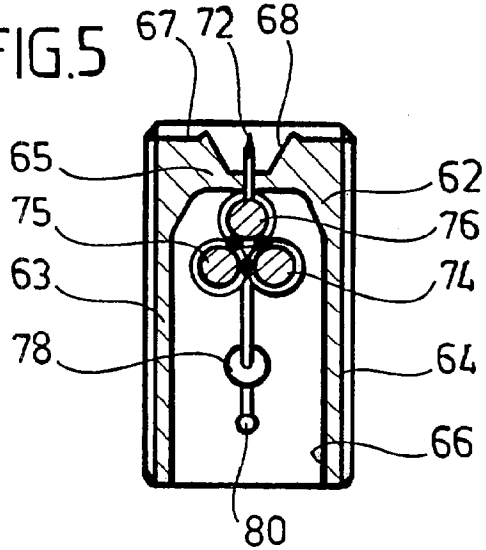
Figure 6:
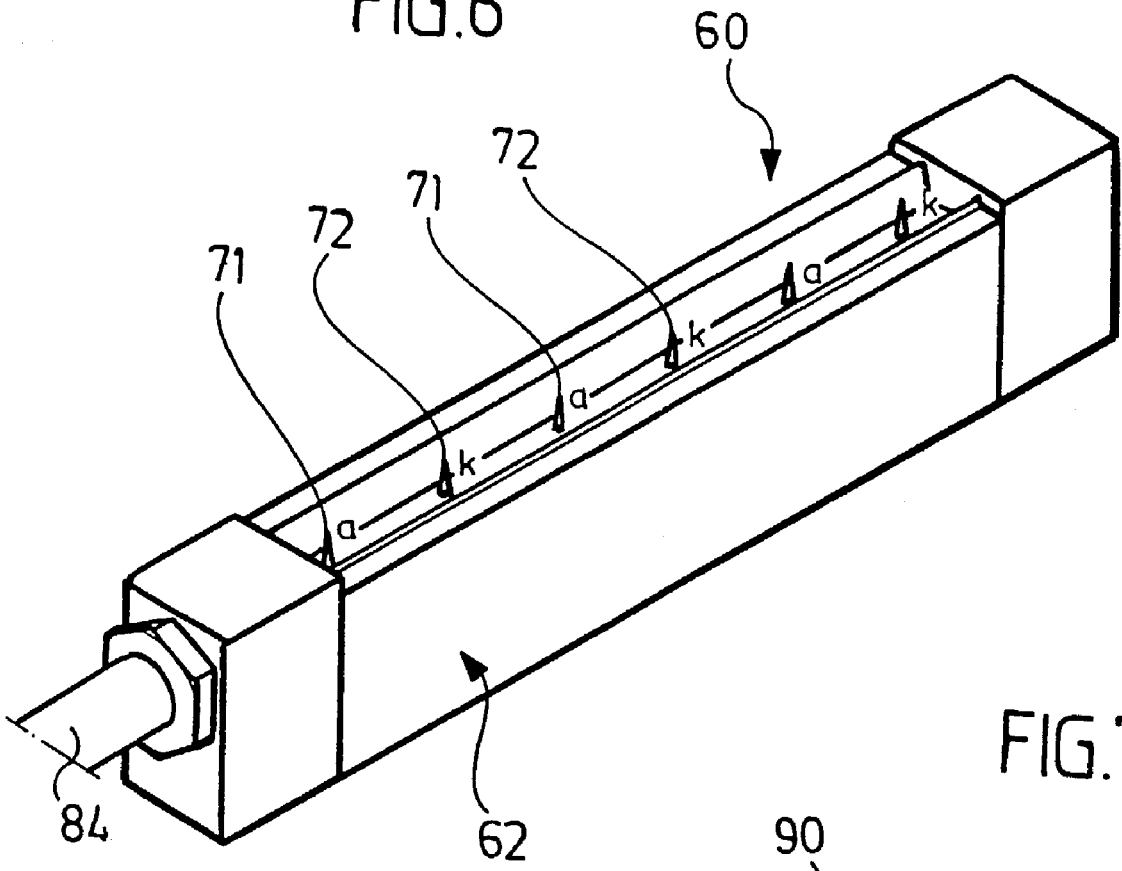
Figure 7:
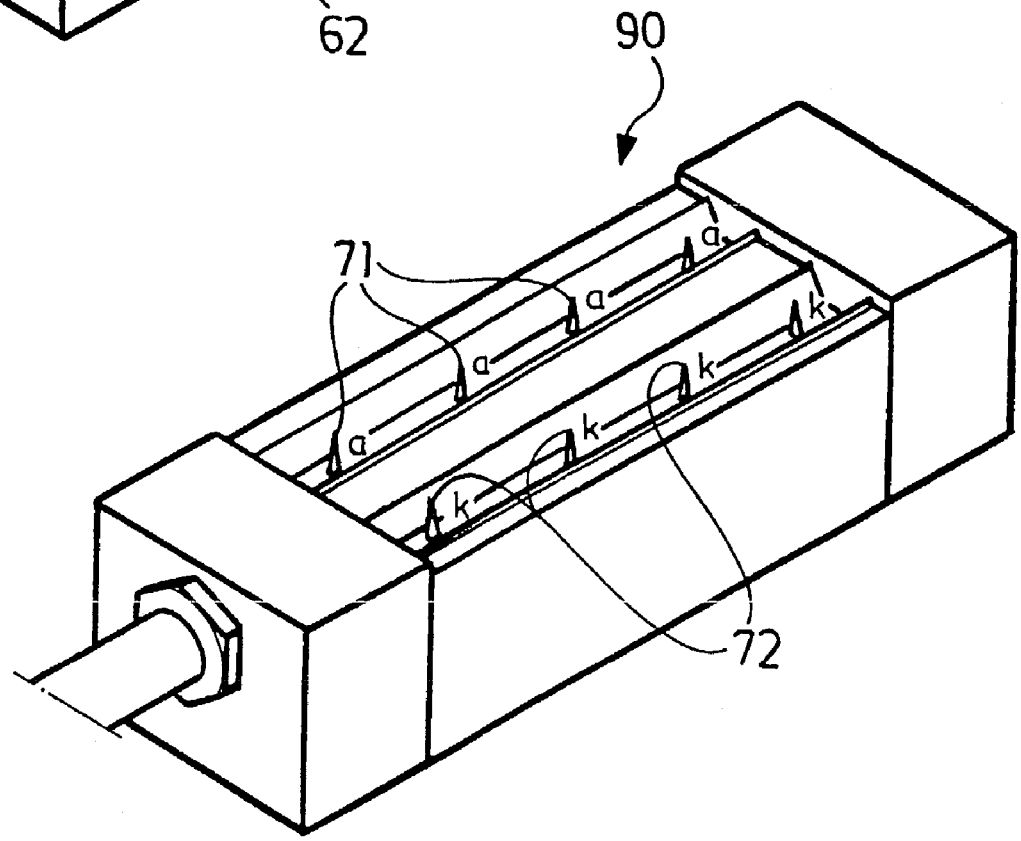
Figure 8:
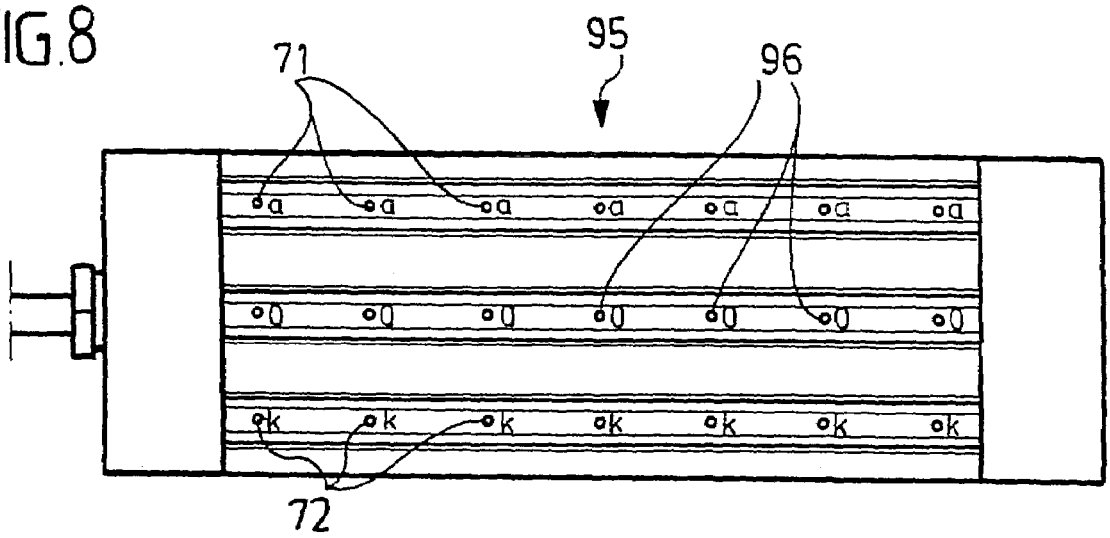
Figure 9:
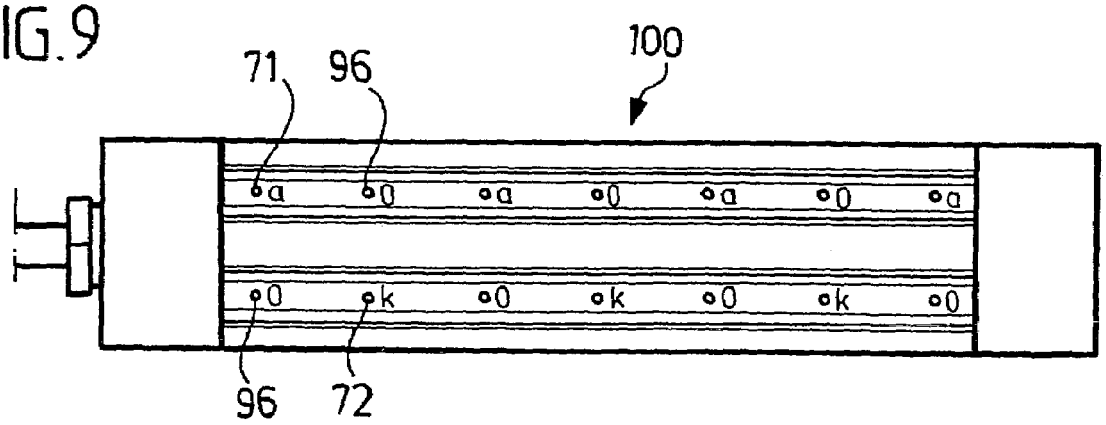
Figure 10:
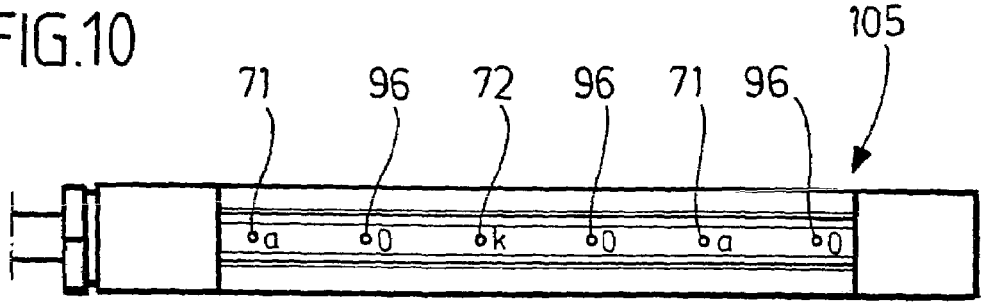

The following description of preferred embodiments of the invention serves to explain the invention in greater detail in conjunction with the drawings. These show:

FIG. 1: a first embodiment of a basic circuit diagram of the point electrodes of an inventive air ionization device for the discharge of a dielectric object;

FIG. 2: an illustration of the temporal course of the potential ratios forming at the point electrodes in accordance with the circuit diagram of FIG. 1;

FIG. 3: a basic illustration of a second embodiment of a circuit diagram of the point electrodes of an inventive air ionization device;

FIG. 4: a partially cutaway side view of a first embodiment of an air ionization device in accordance with the present invention;

FIG. 5: a sectional illustration along line 5—5 in FIG. 4;

FIG. 6: a perspective illustration of the air ionization device in accordance with FIG. 4;

FIG. 7: a perspective illustration of a second embodiment of an inventive air ionization device;

FIG. 8: a plan view of a third embodiment of an inventive air ionization device;

FIG. 9: a plan view of a fourth embodiment of an inventive air ionization device and FIG. 10: a plan view of a fifth-embodiment of an inventive air ionization device;

FIG. 1 shows in a schematic illustration, with the example of two point electrodes designated by the reference numerals 10 and 12, respectively, the connection of the point electrodes of an inventive air ionization device to an AC high voltage power source 14. The two point electrodes 10 and 12 are each coupled capacitively via a capacitor 16 and 18, respectively, to a high voltage line 20 which is connected to a high voltage connection 22 of the AC high voltage power source 14. An AC high voltage can therefore be supplied to the point electrodes 10 and 12 via the high voltage line 20 and the capacitors 16 and 18.

In addition, a respective diode 24 and 26 is connected to the point electrodes 10 and 12, these diodes being connected, in the embodiment illustrated, to an earthed ground connection 30 of the AC high voltage power source 14 via a common ground line 28. Alternatively, it could be provided for the diodes 24 and 26 to be connected to an adjustable, preferably regulatable, DC voltage power source so that the quantity ratio of the positive and negative charge carriers can be influenced by altering the DC voltage potential.

The two diodes 24 and 26 are connected in opposite directions to one another in such a manner that the point electrode 10 is connected to the cathode 32 of the diode 24, the anode 34 of which is connected to the ground line 30, while the point electrode 12 is connected to the anode 36 of the diode 26, the cathode 38 of which is connected to the ground line 28.

The temporal course of the potential ratios forming at the point electrodes 10 and 12 is illustrated in FIG. 2 in an idealized manner, wherein leakage currents and corona currents are not taken into consideration in order to achieve a better overview.

The high voltage effective at the point electrode 10 is shifted in the steady state towards positive values on account of the coupling of the point electrode 10 to ground potential via the diode 24 connected in reverse direction when a positive half wave is present whereas the voltage effective at the point electrode 12 is shifted towards negative values on account of the diode 26 connected in the opposite direction to the diode 24. The course of the voltage effective at the point electrode 10 is designated in FIG. 2 as $U_1$, the course of the voltage effective at the point electrode 12 is designated as $U_2$. The AC high voltage made available by the AC high voltage power source 14 is designated as Uq. The AC high voltage Uq has in the embodiment illustrated an amplitude value $U_A$ of approximately 10 kV, the corresponding point-point value $U_{SS}$ is approximately 20 kV.

Since the voltage $U_1$ effective at the point electrode 10 is shifted towards positive values and the voltage $U_2$ effective at the point electrode 12 towards negative values in the steady state, a difference in potential ΔU is formed between the two point electrodes 10 and 12, this difference in potential being independent of time and the value thereof corresponding in practice to the point-point value $U_{SS}$. It has been shown that by means of the circuit diagram shown in FIG. 1 free positive and negative charge carriers are generated continuously and simultaneously at the respective point electrodes 10 and 12 having a more positive and more negative potential, respectively, due to formation of a corona discharge insofar as the difference in potential ΔU between the point electrodes 10 and 12 exceeds the corona voltage used. An earthed counterelectrode is not required. Since the difference in potential ΔU corresponds essentially to the point-point value $U_{SS}$ of the AC high voltage Uq, the amplitude $U_A$ can be selected to be less than the corona voltage used.

It is clear from FIG. 2 that despite connection of the point electrodes 10 and 12 to an AC voltage a permanent corona discharge is maintained on account of the difference in potential ΔU which is independent of time. The discharge current made available to the point electrodes 10 and 12 by the AC high voltage power source 14 via the high voltage line 20 is limited on account of the use of the capacitors 16 and 18, and a passive discharge effect is ensured in the case of highly charged dielectric objects via the DC voltage coupling of the point electrodes 10 and 12 by means of the diodes 24 and 26 since excess charges can be carried away in a forward direction via the diodes.

In FIG. 3, an alternative design of a circuit diagram is illustrated, wherein the same reference numerals as in FIG. 1 are used for identical components. In addition to the point electrodes 10 and 12, a point electrode 40 is used in the circuit diagram illustrated in FIG. 3 and this is coupled via a capacitor 42 to the high voltage line 20 but does not have any additional DC voltage coupling via a diode.

The point electrode 10 is, again, connected to the cathode of the diode 24 while the point electrode 12 is connected to the anode of the diode 26. An ohmic resistor 50 is connected in series to the diodes 24 and 26 in the ground line 30. Whereas the point electrodes 10 and 12 are coupled to ground potential via the associated diodes 24 and 26, respectively, such a DC voltage coupling is not provided for the point electrode 40. As a result, charges can be carried away only from the point electrodes 10 and 12 via the diodes 24 and 26, respectively. In this respect, the ohmic resistor 50 acts as a current limiting element, with the aid of which the forward current of the diodes 24 and 26 is limited in order to avoid any damage. The drop in voltage occurring at the ohmic resistor 50 can be measured. This allows the possibility of making statements concerning the state of the point electrodes and the charges coupled out via the point electrodes.

In the case of the circuit diagram illustrated in FIG. 3, as well, a difference in potential ΔU which is independent of time in its amount occurs between the point electrodes 10 and 12 and, in addition, the high voltage Uq made available by the AC high voltage power source 14 is present at the point electrode 40 coupled capacitively to the high voltage line 20. It has been shown that as a result of the combined use of the point electrodes 10 and 12 coupled to DC voltage and the additional point electrode 40 which has no DC voltage coupling via a diode an overcompensation, i.e., a residual charging of dielectric objects, which often occurs on account of the different mobilities of the positive and negative charge carriers and the different corona voltages used for positive and negative charge carriers, can be greatly reduced.

A first embodiment of an inventive air ionization device having a circuit arrangement of the point electrodes according to FIG. 1 is illustrated schematically in FIGS. 4 to 6 and designated altogether by the reference numeral 60.

The air ionization device 60 comprises an insulating member 62 which is manufactured as an essentially U-shaped profiled rail from a dielectric plastic material and has two arms 63, 64 which are aligned parallel to one another and are connected to one another in one piece via a cross member 65 and form between them a receiving means 66 which extends over the entire length of the insulating member 62.

The insulating member 62 has on its end face 67 facing away from the receiving means 66 a groove 68 which accommodates a point electrode assembly 70. The latter is formed from a plurality of point electrodes 71 and 72 which are aligned in a row along the insulating member 62 and are arranged alternatingly one after the other.

Three helical springs 74, 75, 76 which abut on one another in longitudinal direction and are connected electrically to one another are arranged within the receiving means 66 and associated with a respective point electrode 71 or 72, wherein one end of the helical spring 76 arranged directly adjacent to the cross member 65 projects radially, passes through an opening integrally formed in the cross member 65 and dips into the groove 68. This spring end forms a point electrode 71 or 72. An end of the helical spring 75 arranged at a distance to the cross member 65 projects radially in the direction facing away from the point electrodes 71, 72 and is connected to a diode 77 and 78, respectively, which, for its part, is connected to a ground line 80 extending parallel to the groove 68 within the receiving means 66. The diode 77 associated with the point electrode 71 is, in this respect, connected on the anode side to the helical spring 75 whereas the diode 78 associated with the point electrode 72 is connected on the cathode side to the helical spring 75. The cathode sides of the diodes 77 and 78 are marked in FIG. 4 by a respective, beam-like marking.

The helical springs 74, 75 and 76 surround a high voltage line 82 which extends in a loop-like manner in the receiving means 66 and to which an AC high voltage can be connected via a supply line 84. The point electrodes 71, 72 are coupled capacitively to the high voltage line 72 via the helical springs 74, 75, 76 since the helical springs 74, 75 and 76 each form a capacitor, via which the AC high voltage made available by the high voltage line 72 can be transferred to the point electrodes 71, 72. The supply line 84 comprises in the customary manner for shielding the high voltage a braided shield which is connected to the ground line 80. This is not illustrated in the drawings. For the purpose of electrical insulation, the entire receiving means 66 with the helical springs 74, 75, 76 and the diodes 77 and 78 as well as the high voltage line 82 and the ground line 80 is lined with an electrically insulating plastic material, for example, polyurethane.

It is clear from the above that the point electrode assembly 70 comprises a plurality of point electrodes 71 and 72 which are coupled capacitively to the high voltage line 82 and are connected, in addition, to ground potential via the diodes 77 and 78, respectively. In this respect, the point electrodes 71 are connected to the anode of the associated diode 77 via the helical springs 74, 75, 76 whereas the point electrodes 72 are connected to the cathode of the associated diode 78 via the helical springs 74, 75, 76. The connection of the point electrodes 71, 72 is therefore brought about in accordance with the circuit diagram illustrated in FIG. 1.

The alternating arrangement of point electrodes 71, 72, which are connected to the anode side and the cathode side, respectively, of a diode and connected via them to a DC voltage potential, to ground potential in the embodiment illustrated, is apparent, in particular, from FIG. 6. In this respect, the point electrodes 71 connected to the anode side of the diode 77 are designated, in addition, as a and the point electrodes 72 connected to the cathode side of the diode 78 are designated as k.

In FIG. 7, an alternative design of an air ionization device is illustrated which is designated, altogether, by the reference numeral 90. It differs from the air ionization device 60 described above with reference to FIGS. 4, 5 and 6 only in that two rows of point electrodes are arranged next to one another, wherein the first row comprises point electrodes 71 which are connected to the anode side of the associated diode 77 whereas the second row has point electrodes 72 which are connected to the cathode side of the associated diodes 78. As for the rest, the air ionization device 90 is designed in accordance with the air ionization device 60 and so reference is made to the preceding explanations to avoid repetitions.

As already explained, it is of advantage, in order to avoid overcompensations, i.e., to avoid residual charging on account of the different mobilities of the positive and negative charge carriers and the different corona voltages used for positive and negative charge carriers, when, in addition to point electrodes 71, 72 which are coupled to a DC voltage potential by means of a diode, point electrodes are also used which are merely coupled capacitively to the high voltage line 82 but not, in addition, to a DC voltage potential. An air ionization device with such a connection of the point electrodes is illustrated in FIG. 8 and designated, altogether, by the reference numeral 95. This differs from the air ionization device 10 described above merely in that, in addition to the point electrodes 71 and 72, point electrodes 96 are also used which are not connected to the ground line 80. As for the rest, the air ionization device 95 has a construction corresponding to that of the air ionization device 60 and so the same reference numerals as in FIGS. 4, 5 and 6 are used for identical components.

In the case of the air ionization device 95 illustrated in FIG. 8, the point electrodes 71, 72 and 96 are arranged in respective rows at a distance from one another, wherein the point electrodes 96 not having any DC voltage coupling are arranged between the respective point electrodes 71 and 72 connected to the ground line 80 via a diode 77 and 78, respectively.

In FIG. 9, a further, alternative embodiment of an air ionization device is illustrated which is designated, altogether, by the reference numeral 100. It differs from the air ionization device 95 only in that only two rows of point electrodes are used altogether, wherein in a first row point electrodes 71 and 96 are arranged alternatingly and in the second row point electrodes 72 and 96 are arranged alternatingly.

Finally, an air ionization device 105 is illustrated in FIG. 10 which, in a design corresponding to the air ionization device 60 illustrated in FIGS. 4, 5 and 6, comprises only a single row of point electrodes. In contrast to the air ionization device 60, point electrodes 96 which have no DC voltage coupling are positioned each time between the point electrodes 71 and 72 which are coupled to a DC voltage potential and are arranged alternatingly.

The air ionization devices described above with reference to FIGS. 1 to 10 are used for the discharge of a dielectric object, wherein not only positive but also negative charge carriers are continuously generated. If only one type of charge carrier is to be generated for the charging of an object, one row of point electrodes 71 and 72, respectively, (cf. FIG. 8) which are connected to a diode exclusively on the cathode side or exclusively on the anode side can be connected to an AC voltage power source for this purpose. Only positive or only negative charge carriers are then generated, depending on the polarity of the associated diodes, and these can be applied to the object to be charged.

The invention claimed is:

1. Air ionization device, comprising:

a high voltage line connectable to an AC voltage power source; and point electrodes coupled capacitively to the high voltage line for generating a corona discharge; wherein:

at least two of said point electrodes are each connected via an associated diode to an externally defined DC voltage potential and are each connected via an associated capacitor to the high voltage line;

a first of said at least two point electrodes is connected to the cathode side of the associated diode and a second of said at least two point electrodes is connected to the anode side of the associated diode;

the corona discharge is adapted to be formed between the first and second electrodes; and positive charge carriers are generatable at the first point electrode and negative charge carriers are generatable at the second point electrode continuously and simultaneously;

each diode is directly connected to the associated point electrode, and each capacitor is directly connected to the associated point electrode.

2. Air ionization device as defined in claim 1, wherein the air ionization device has at least a third point electrode not coupled to said DC voltage potential.

3. Air ionization device as defined in claim 1, wherein the point electrodes which are connected to said associated diode are connected to earth potential via the associated diode.

4. Air ionization device as defined in claim 1, wherein the diodes which are connected to the point electrode are connected in series to a current limiting element.

5. Air ionization device as defined in claim 1, wherein the externally defined DC potential comprises earth potential.

6. Air ionization device as defined in claim 1, wherein the externally defined DC potential comprises an adjustable DC potential.

7. Air ionization device comprising:

a high voltage line connectable to an AC voltage power source; and point electrodes coupled capacitively to the high voltage line for generating a corona discharge; wherein:

at least two of said point electrodes are each connected via an associated diode to an externally defined DC voltage potential and are each connected via an associated capacitor to the high voltage line;

a first of said at least two point electrodes is connected to the cathode side of the associated diode and a second of said at least two point electrodes is connected to the anode side of the associated diode;

the corona discharge is adapted to be formed between the first and second electrodes; and positive charge carriers are generatable at the first point electrode and negative charge carriers are generatable at the second point electrode continuously and simultaneously;

at least two rows of said point electrodes are provided, a first row of said at least two rows of said point electrodes having said point electrodes connected on the cathode side to the associated diode which is connected to said DC voltage potential, and a second row of said at least two rows of said point electrodes having said point electrodes connected on the anode side to said associated diode which is connected to said DC voltage potential.

8. Air ionization device as defined in claim 7, wherein a third row of said point electrodes not coupled to said DC voltage potential is arranged between the first and the second rows of said point electrodes.

9. Air ionization device comprising:

a high voltage line connectable to an AC voltage power source; and point electrodes coupled capacitively to the high voltage line for generating a corona discharge; wherein:

at least two of said point electrodes are each connected via an associated diode to an externally defined DC voltage potential and are each connected via an associated capacitor to the high voltage line;

a first of said at least two point electrodes is connected to the cathode side of the associated diode and a second of said at least two point electrodes is connected to the anode side of the associated diode;

the corona discharge is adapted to be formed between the first and second electrodes;

positive charge carriers are generatable at the first point electrode and negative charge carriers are generatable at the second point electrode continuously and simultaneously;

at least one row of said point electrodes are provided, and said point electrodes which are connected to said DC voltage potential and said point electrodes which are not connected to said DC voltage potential are arranged one after the other.

10. Air ionization device as defined in claim 9, wherein said point electrodes connected to said DC voltage potential and said point electrodes not connected to said DC voltage potential interchange alternatingly.

11. Air ionization device as defned in claim 9, wherein:

at least two rows of said point electrodes are provided, in a first row of said at least two rows of said point electrodes, said point electrodes connected on the cathode side to said associated diode and via said associated diode to said DC voltage potential and said point electrodes not coupled to said DC voltage potential are arranged alternatingly one after the other; and in a second row of said at least two rows of said point electrodes, said point electrodes connected on the anode side to said associated diode and via said associated diode to said DC voltage potential and said point electrodes not coupled to said DC voltage potential are arranged alternatingly one after the other.

12. Air ionization device as defined in claim 9, wherein:

each diode is directly connected to the associated point electrode, and each capacitor is directly connected to the associated point electrode.

* * * * *

UNITED STATES PATENT AND TRADEMARK OFFICE

CERTIFICATE OF CORRECTION

PATENT NO. : 7,170,734 B2
APPLICATION NO. : 10/300691
DATED : January 30, 2007
INVENTOR(S) : Muz It is certified that error appears in the above-identified patent and that said Letters Patent is hereby corrected as shown below:

Column 8, line 34
Insert the word --point-- before “electrodes”

Column 8, line 52
Insert an --s-- at the end of “electrode”

Column 9, line 6
Insert the word --point-- before “electrodes” and delete “and” at the end of the line Column 10, line 2
Insert the word --point-- before “electrodes”

Signed and Sealed this

Fifteenth Day of May, 2007

JON W. DUDAS
*Director of the United States Patent and Trademark Office*